US005563377A

United States Patent [19]

Arpin et al.

[11] Patent Number: 5,563,377

[45] Date of Patent: Oct. 8, 1996

[54] TELECOMMUNICATIONS CABLE

[75] Inventors: Benoit Arpin, Ste-Julie; Gayriel L. Vexler, Westmount, both of Canada

[73] Assignee: Northern Telecom Limited, Montreal, Canada

[21] Appl. No.: 261,073

[22] Filed: Jun. 16, 1994

Related U.S. Application Data

[63] Continuation-in-part of Ser. No. 215,544, Mar. 22, 1994, abandoned.

[51] Int. Cl.[6] ..... H01B 7/34

[52] U.S. Cl. ..... 174/121 A; 174/110 PM; 174/110 FC; 174/120 R

[58] Field of Search ..... 174/110 PM, 110 FC, 174/120 R, 120 SR, 121 A, 113 R

[56] References Cited

U.S. PATENT DOCUMENTS

| | | | |
|---|---|---|---|
| 3,571,490 | 3/1971 | Bunish | 174/113 R |
| 3,650,827 | 3/1972 | Brown et al. | 117/218 |
| 4,456,654 | 6/1984 | Kotain | 428/383 |
| 4,500,748 | 2/1985 | Klein | 174/121 A |
| 4,549,041 | 10/1985 | Shingo et al. | 174/113 R |
| 5,010,210 | 4/1991 | Sidi et al. | 174/34 |
| 5,032,321 | 7/1991 | Breant | 252/609 |
| 5,162,609 | 11/1992 | Adriaenssens et al. | 174/34 |
| 5,173,960 | 12/1992 | Dickinson | 385/100 |
| 5,253,317 | 10/1993 | Allen et al. | 385/109 |

*Primary Examiner*—Kristine L. Kincaid
*Assistant Examiner*—Marc D. Matchtinger

[57] ABSTRACT

A telecommunications cable having a cable core in which each conductor is surrounded by an individual dual layer insulation of an inner layer of flame retardant polyolefin and an outer layer of fluorinated ethylene propylene. The cable is for plenum chamber usage in which smoke is to be minimized. Although the flame retardant polyolefin is a known smoke generating substance which does not satisfy plenum test smoke requirements, its use in this structure is entirely suitable for plenum chamber use because little or no smoke is actually generated as the outer layer protects the inner layer from combustion.

2 Claims, 1 Drawing Sheet

TELECOMMUNICATIONS CABLE

This invention relates to telecommunications cables and is a continuation-in-part application of Ser. No. 08/215,544 by B. Arpin, et al filed Mar. 22, 1994 entitled "Telecommunications Cable", now abandoned.

Telecommunication cable designs vary according to the role which the cables are meant to fulfill. In building design, it is always of paramount importance to take every precaution possible to resist the spread of flame and the generation of and spread of smoke throughout a building in case of an outbreak of fire. This clearly is a main aim as protection against loss of life and also to minimize the cost of the fire in relation to the destruction of electrical and other equipment. With this in mind, for cables designed for installation in plenum chambers of air circulation systems in buildings, care needs to be taken to ensure that the cables have maximum resistance to flame spread and also produce minimum amounts of smoke which reduces the chances of visibility becoming obscured, thereby greatly increasing the chances of people within the building finding their way to safety.

Conventional designs of data grade telecommunications cables for installation in plenum chambers have a low smoke generating jacket material, e.g. of a PVC formulation or a fluoropolymer material, surrounding a core of twisted conductor pairs, each conductor individually insulated with a fluorinated ethylene propylene insulation layer. The latter is the only material currently used as conductor insulation in this type of cable, due to its flame retardant, smoke retardant and good electrical properties and which is capable of satisfying recognized plenum test requirements such as the "peak smoke" and "average smoke" requirements of the UL910 Steiner test and/or CSA FT6 (plenum flame test) while enabling the cable to achieve a desired electrical performance under recognized test requirements EIA/TIA-568 and TSB-36 for high frequency signal transmission.

While the above-described cable is capable of meeting all of the above design criteria, undoubtedly the use of fluorinated ethylene propylene is extremely expensive and may account for up to 60% of the cost of a cable designed for plenum usage.

On the other hand, in another design of telecommunications cable for in-building usage, such cables are not for use in plenum of air circulation systems, instead these cables are to be installed in risers in buildings extending from floor-to-floor. While it is recognized that flame spread in such a cable is important, nevertheless the production of smoke is not considered to be a major issue because it is unlikely that smoke from such a cable could reach populated areas within the building. As a result therefore, the conductors in a riser cable are not normally insulated with the expensive fluorinated ethylene propylene but are insulated with a less expensive material such as a flame retardant polyolefin. Cables with conductors insulated with flame retardant polyolefin could not satisfy the above discussed plenum test requirements. Clearly, therefore, no thought would be given to using flame retardant polyolefin as used in a riser design cable for a plenum cable because of the problems associated with the production of smoke in plenum cable designs.

The present invention seeks to provide a cable design suitable for in plenum chamber use while meeting all of the requirements for such use and in which the cable is less expensive than conventional cables for plenum chamber usage.

According to the present invention there is provided a telecommunications cable having a cable core comprising a plurality of electrical conductors each individually insulated with a dual layer of insulation having an inner layer of a flame retardant polyolefin and an outer layer of fluorinated ethylene propylene surrounding the inner layer, the core being provided within a jacket of low smoke generating material.

The cable according to the invention has been found to be suitable for in-plenum chamber usage. This is surprising in view of the fact that flame retardant polyolefin is used in the structure and this has previously been considered unsuitable for plenum chamber usage because of its known characteristic of generating opaque smoke during a fire. It has been discovered, however, in the inventive concept that the fluorinated ethylene propylene layer in its flame spread resistant function, is sufficiently protective of the fire resistant polyolefin that flame contact with the flame retardant polyolefin and flame spread along the flame retardant polyolefin is dampened to such a degree that little or no opaque smoke is generated. This is even more surprising in that the flame retardant polyolefin and the fluorinated ethylene polypropylene are incompatible materials and do not adhere easily together. As a result, it could be imagined that the outer layer of fluorinated ethylene propylene would readily melt away thereby exposing the inner layer to excessive fire consumption and smoke generation. However this has not been found to be case, as the fluorinated ethylene propylene effectively dampens the flame spread and smoke generation created by the flame retardant polyolefin as discussed above. The degree of protection offered by the fluorinated ethylene propylene to the fire retardant polyolefin must of course be dependent upon the thickness of the fluorinated ethylene propylene.

In preferred cables, the fluorinated ethylene propylene layer has a minimum thickness of 2 mil to afford the required protection, the remainder of the insulated thickness being provided by the flame retardant polyolefin to produce the required electrical characteristics to the cable. In a preferred arrangement, the inner layer of fire retardant polyolefin occupies at least 30% by volume of the total volume of the dual layer insulation. Cable designs having dual layer insulations for the conductors of fluorinated ethylene propylene and fire retardant polyolefin have been successfully tested at ETL for the plenum flame test under UL910 Steiner requirements. The electrical characteristics of the cables have been evaluated and meet the requirements of EIA/TIA-568 and TSB36.

One embodiment of the invention will now be described, by way of example, with reference to the accompanying drawings, in which.

Figure 1:
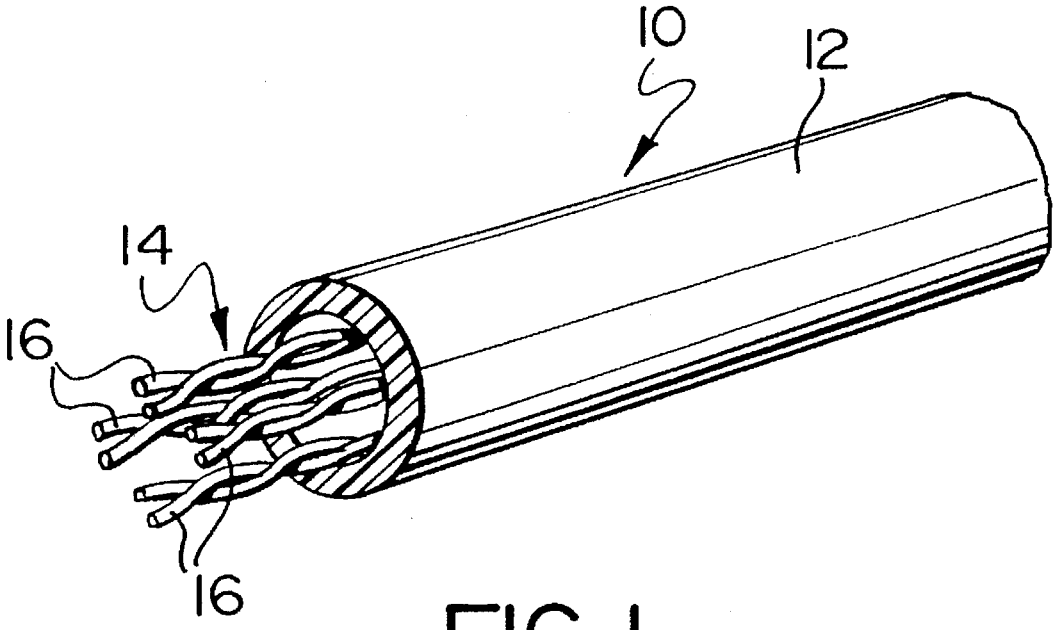
FIG. 1 is an isometric view of a cable according to the embodiment.

As shown in the embodiment of FIG. 1 a telecommunications plenum cable 10 suitable for high performance data transmission, comprises a jacket 12 of minimal smoke emission polyvinyl chloride or Halar fluoropolymer, the jacket surrounding a cable core 14 formed by a plurality, namely four, pairs of twisted together and individually insulated conductors 16.

Figure 2:
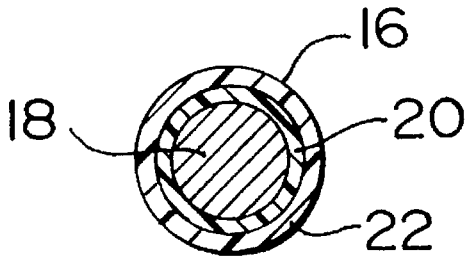
FIG. 2 is a cross-sectional view through an insulated conductor of the cable of FIG. 1.

As shown by FIG. 2, each individually insulated conductor 16 comprises a twenty-four AWG copper conductor 18 surrounded by a dual insulation. The dual insulation comprises an inner insulating layer 20 made from a flame retardant polyolefin e.g. polyethylene, and an outer layer surrounding the inner layer, the outer layer 22 formed from fluorinated ethylene propylene. In this embodiment, the inner layer has a thickness of about 3.5 mil and the outer layer has a thickness of approximately 3.5 mil. The two layers are provided by successive extrusion steps, possibly within a dual extrusion head of known structure. The two materials are likely incompatible and there is little or no adherence between the layers. In this embodiment it has been found that with the dual insulation thickness of 7.0 mil, the cable is entirely suitable for use in plenum chamber conditions. In the event of a fire, it has been determined that the flame spread characteristics are satisfactorily low as successfully tested at ETL and coming within the flame spread standards for plenum cable as set by the UL910 Steiner test. Electrical characteristics of the cable have been evaluated and it is believed that for high frequency performance the cable satisfactorily meets EIA/TIA-568 and TSB-36 standards.

Although the cable of the embodiment does not use fluorinated ethylene propylene exclusively for its insulation, but instead uses flame retardant polyethylene as an inner layer to the fluorinated ethylene propylene outer layer, nevertheless satisfactory results have been achieved. Surprisingly, although the flame retardant polyethylene conventionally is avoided for plenum cable constructions, in the invention and as shown by the embodiment it was shown that material is suitable as the inner layer insulation for plenum cables. The electrical properties were achieved as stated by the dual layer insulation as also were the flame retardant properties. Although the flame retardant polyethylene was incorporated, this incorporation was, of necessity as an inner layer of the dual insulation structure and in this position, it was found that the fluorinated ethylene propylene outer layer minimized the contact of flame with the inner layer and thereby controlled the degree of flame spread along the inner layer and also inhibited the generation of smoke by the polyethylene. This is a surprising result in that it could not have been previously supposed that flame retardant polyethylene could have been satisfactory under any circumstances for use as an insulation for plenum cables. The low smoke test results were also surprising in view of the fact that the two layers of insulation are not compatible and the view could have been taken that the lack of adhesion between the layers would have assisted in the flame spread along the flame retardant polyethylene. However, this has been found not to be the case that the incompatibility of the two materials produces a negligible result.

The UL910 Steiner test requirements are for a maximum flame spread of 5 ft. peak smoke lower than 0.5, and average smoke lower than 0.15. The cable of the embodiment under test conditions, produced a maximum flame spread of 0.9 ft. peak smoke of 0.394 and average smoke of 0.102.

In the above embodiment, the fluorinated polyethylene occupies approximately 44% by volume of the total volume of the dual layer insulation. It is believed that satisfactory results may be obtained while using a minimum of 30% by volume of the flame retardant polyethylene of the total volume of the insulation. In addition for the purpose of providing a protection against flame spread of the flame retardant polyethylene, the fluorinated ethylene propylene outer layer should have a minimum thickness of 2 mil. In other constructions falling within the scope of the present invention, the advantages expressed above also apply to different thicknesses of insulation with preferably the inner layer having a volume of at least 30% of the total volume of the dual layer insulation; it also applies to different conductor sizes, e.g. 22 AWG conductor. The total thickness of the insulation is comparable to the insulation of a totally fluorinated ethylene propylene insulation provided upon a 22 or 24 AWG conductor in a conventional plenum type telecommunications cable.

What is claimed is:

1. A telecommunications cable having a cable core comprising a plurality of electrical conductors each individually insulated with a dual layer insulation having an inner layer of a flame retardant polyolefin and an outer layer of fluorinated ethylene propylene surrounding the inner layer and wherein the inner layer has a volume of at least 30% of the total volume of the dual layer insulation, the core being provided within a jacket of low smoke generating material.

2. A telecommunications cable having a cable core comprising a plurality of electrical conductors each individually insulated with a dual layer insulation having an inner layer of a flame retardant polyolefin and an outer layer of fluorinated ethylene propylene surrounding the inner layer, the outer layer having a minimum thickness of 2 mil and the core being provided within a jacket of low smoke generating material.

* * * * *

UNITED STATES PATENT AND TRADEMARK OFFICE

CERTIFICATE OF CORRECTION

PATENT NO. : 5,563,377

DATED : October 8, 1996

INVENTOR(S) : Benoit Arpin, Gavriel L. Vexler

It is certified that error appears in the above-indentified patent and that said Letters Patent is hereby corrected as shown below:

On title page, item

[75] Inventors: change "Gayriel" to --Gavriel--.

Signed and Sealed this

Twelfth Day of August, 1997

Bruce Lehman

*Attest:*

BRUCE LEHMAN

*Attesting Officer*

*Commissioner of Patents and Trademarks*